US005157788A

United States Patent [19]

Schultz

[11] Patent Number: 5,157,788

[45] Date of Patent: Oct. 27, 1992

[54] VENTILATED, HEAT ATTENUATING HEADWEAR

[76] Inventor: Jeffrey P. Schultz, 563 107th Ave. N., Naples, Fla. 33963

[21] Appl. No.: 702,041

[22] Filed: May 17, 1991

[51] Int. Cl.[5] ..... A42B 1/00

[52] U.S. Cl. ..... 2/7; 2/195; 2/DIG. 1

[58] Field of Search ..... 2/4, 7, 8, 171, 175, 2/192, 195, 200, 209.3, 209.5, 209.7, 410, DIG. 1

[56] References Cited

U.S. PATENT DOCUMENTS

| | | | |
|---|---|---|---|
| 2,681,451 | 6/1954 | Lipschutz | 2/195 |
| 3,594,814 | 7/1971 | Schuessler | 2/410 |
| 3,786,519 | 1/1974 | Aileo | 2/209 |
| 4,148,958 | 4/1979 | Tischer | 2/7 |
| 4,397,045 | 8/1983 | Schonwetter | 2/7 |
| 4,551,857 | 11/1985 | Galvin | 2/7 |
| 4,716,594 | 1/1988 | Shannon | 2/DIG. 1 |
| 4,912,778 | 4/1990 | Daniels | 2/7 |
| 4,972,520 | 11/1990 | Grilliot | 2/410 |
| 4,985,933 | 1/1991 | Lemoine | 2/4 |

*Primary Examiner*—Werner H. Schroeder
*Assistant Examiner*—Diana L. Biefeld
*Attorney, Agent, or Firm*—William E. Noonan

[57] ABSTRACT

A ventilated, heat attenuating hat is disclosed including an inner mesh section that has a crown portion for engaging the crown of a wearer's head and a pair of side portions connected to the crown portion for engaging the sides of the wearer's head. There is an outer mesh section interconnected to the inner mesh section for covering at least a portion of the inner mesh section. A channel is formed between the inner and outer mesh sections for allowing air to flow freely therethrough. The outer mesh section includes a metallized fabric for reflecting away from the hat a significant of solar radiation that strikes the outer mesh section.

15 Claims, 3 Drawing Sheets

VENTILATED, HEAT ATTENUATING HEADWEAR

FIELD OF THE INVENTION

This invention relates to ventilated, heat attenuating headwear and, more particularly, to a hat designed to keep the wearer cool and dry, particularly during outdoor activities.

BACKGROUND OF THE INVENTION

Conventional hats protect the wearer from heat by shading the head from the sun's rays. Unfortunately, most headwear also prevents air from circulating through the hat. As a result, air circulation cannot cool the wearer and the hat traps the wearer's body heat. Previously known ventilated hats have attempted to alleviate this problem by using a single layer of mesh or other material employing ventilation openings in the hat surface. However, although these hats improve ventilation somewhat, they also transmit a significant amount of sunlight, which strikes and heats the wearer. Additionally, the cloth coverings and sweatbands utilized by some prior art hats tend to become quickly saturated with perspiration, thereby interfering with the body's natural cooling. Such perspiration soaked cloth material is also quite uncomfortable.

A known hat employs two layers of mesh over the top or crown of the wearer's head. However, that hat disposes a layer of fiberglass between the mesh layers. As a result, proper ventilation is hindered. Moreover, solar radiation is not adequately blocked through the sides of the hat.

SUMMARY OF INVENTION

It is therefore an object of this invention to provide a hat which effectively blocks solar radiation from striking the wearer, while at the same time allowing a significant amount of air to flow through the hat and cool the wearer.

It is a further object of this invention to provide a hat that helps to keep the wearer relatively cool, dry and comfortable, particularly during rigorous outdoor activities.

This invention results from a realization that an improved hat for outdoor activities may be constructed by utilizing an inner, perspiration wicking and evaporative mesh layer for engaging the crown and sides of the wearer's head and an outer, radiation reflecting mesh layer for repelling away from the wearer's head a majority of the solar radiation that strikes the outer mesh layer. Such a hat structure deflects incident heat and light and, at the same time, ventilates and cools the wearer.

Accordingly, this invention features ventilated, heat attenuating headwear that includes an inner mesh section having a crown portion for engaging the crown of a wearer's head and a pair of side portions connected to the crown portion for engaging the sides of the wearer's head. There is an outer mesh section that covers at least a part of the inner mesh section and means are provided for interconnecting the inner and outer mesh sections. Channel means are provided between the inner and outer mesh sections for permitting air to flow freely between the outer and inner sections.

In a preferred embodiment, the inner mesh section includes a wicking and evaporative material that may comprise a hydrophobic fabric. The inner mesh section may also include a metallic material for reflecting solar radiation therefrom. The metallic material may include an aluminized or otherwise metallized fabric. Preferably the outer mesh section includes means for reflecting away from the headwear a portion of solar radiation that strikes the outer mesh section. The means for reflecting may similarly include an aluminized or otherwise metallized fabric.

Means may be disposed between the inner mesh section and the outer mesh section for supporting the outer mesh section in a generally erect condition over the inner mesh section. Such means for supporting preferably include a support grid that is generally rigid relative to the material composing the inner and outer mesh sections. The outer mesh section may include openings formed in the support grid for permitting ventilation therethrough. The outer mesh section is preferably attached to the support grid. The support grid may include an elongate member having opposite first and second ends and may further include a first adjustment element carried by the first end of the support grid and a complementary second adjustment element carried by the second end of the support grid. A recessed region may be formed in the inner and outer mesh sections proximate the rear of the headwear. The first and second adjustment elements extend into the recessed region and include complementary means for interengaging the elements at a selected one of a plurality of relative positions to adjust the size of the headwear.

A bill section may be joined to and extend from the inner and outer mesh sections and may include a metallic material for reflecting solar radiation therefrom.

DETAILED DESCRIPTION OF PREFERRED EMBODIMENT

Other objects, features and advantages will occur from the following description of a preferred embodiment and the accompanying drawings in which.

Figure 1:
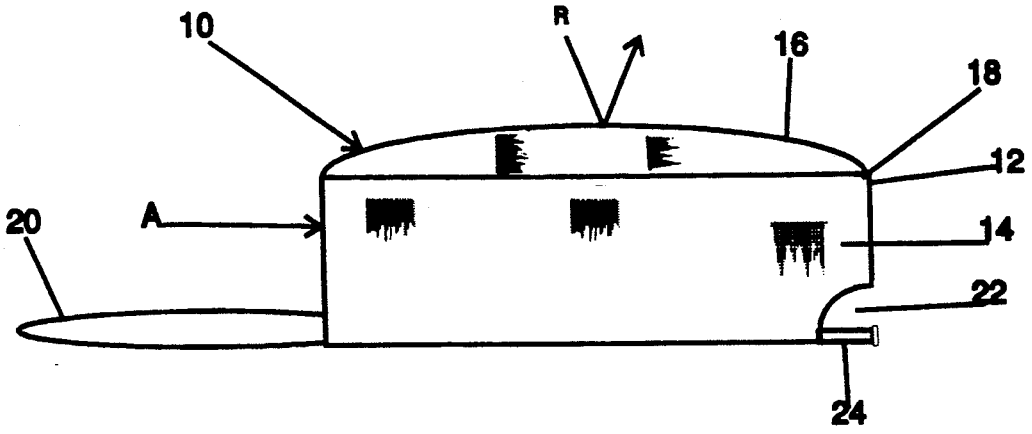
FIG. 1 is an elevational side view of a ventilated, heat attenuating hat in accordance with this invention.

The ventilated, heat attenuating headwear of this invention employs a pair of interconnected inner and outer mesh layers or sections. The inner mesh section includes a crown portion for engaging the crown of the wearer's head and a pair of side portions connected to the crown portion for engaging the sides of the wearer's head. The crown and side portions are preferably joined by conventional sewing techniques. However, in alternative embodiments a one-piece inner mesh section may be employed.

The inner mesh section is designed to provide an optimum degree of ventilation and dryness for the wearer. Preferably, it should be composed of a woven or knitted hydrophobic fabric that wicks perspiration away from the skin of the wearer and evaporates that perspiration at a desirable rapid rate. A preferred material for the inner mesh is COOLMAX (TM) fabric certified by Dupont Corporation. This material provides an optimum degree of ventilation and exhibits exceptional wicking capabilities. As a result, the wearer stays relatively cool and dry, even during strenuous activities. Various alternative fabrics, such as those distributed under the brand names Aquator, Drylete, Hydrofil and Prolite Propylene, may also be employed.

The outer mesh section is primarily intended to reflect a significant portion of incident solar radiation away from the hat. To accomplish this purpose, the headwear preferably employs a metallized fabric. A particularly preferred material is aluminized yarn. Such yarn may be, for example, 1/32" in diameter and may include a non-laminated single ply polyester film that is metallized with an aluminum deposit on one side. A clear, colorless lacquer is applied over the metallized side. Such yarn may be manufactured on conventional machinery using various known knitting or weaving techniques. The outer mesh section may include a single integral piece or multiple segments that are sewn or stitched together in a conventional manner. The mesh reflects a significant portion of the solar radiation striking the hat and, at the same time, permits air to pass through the outer section to aid in ventilating the wearer.

A certain amount of solar radiation passes through the outer mesh section. To reduce the detrimental effects of this transmitted radiation, the inner mesh section may also include a radiation attenuating material such as an aluminized fabric. Such material is preferably provided on the outside surface of the inner mesh section. More particularly, the metallized fabric may be secured to the wicking material by conventional knitting processes such as plating.

The inner and outer mesh sections are interconnected by a variety of known means such as stitching, sewing or adhesives. Typically, this interconnection is made along and proximate to the brim of the cap. Various conventional stitching techniques, such as flat feld seams, may be employed.

It is of critical importance that an open channel is provided between the inner and outer mesh sections so that ventilating air can flow freely between them. This channel may comprise an open space between the mesh sections. Alternatively a structural element with open air passageways may be disposed between the mesh sections.

A mesh support grid or alternative support structure is employed between the inner and outer sections to maintain the outer, heat reflecting mesh layer in a generally erect condition. The support grid is preferably composed of a plastic material that is relatively rigid compared to the inner and outer mesh sections. The grid itself may have openings formed therethrough. These openings define the inter-mesh channel to permit ventilation through the hat. A particularly preferred grid includes a plastic mesh, although it should be understood that various materials and designs may be employed.

The grid may carry a pair of extension sections that form an adjustment strap for the hat. In alternative embodiments, conventional adjustment straps and fasteners may be secured to the grid or otherwise employed in the hat so that the size of the headwear may be adjusted in a conventional manner. These fasteners may comprise plastic, Velcro, a drawstring or an elastic sewn into the brim of the hat.

A bill may be attached to the front of the hat by various conventional techniques. The bill preferably includes an aluminized fabric, as described above, that is laminated or otherwise secured to the upper surface of the bill. This further enhances the heat reflecting capabilities of the headwear. An aluminized fabric such as FABRIFOIL (TM) may be used in the bill. It has been determined that FABRIFOIL (TM) reflects at least 85% of incident radiation.

Tests performed on headwear constructed according to this invention indicate that greatly improved heat attenuation and ventilation are achieved. For example, these tests have revealed that by employing the dual mesh structure of this invention approximately 83% of incident solar radiation is blocked from striking the wearer's head. At the same time, approximately 42% of the air flow impinging on the hat is transmitted through the hat to the wearer. As a result, a large majority of the incident light is deflected away from the wearer and a significant amount of air is permitted to circulate through the hat to engage the wearer's head. Moreover, the hydrophobic wicking fabric quickly eliminates perspiration. The wearer is therefore shaded, ventilated and kept relatively dry. As a result, the hat is particularly effective for keeping the wearer cool and comfortable during various vigorous outdoor activities such as running and bicycling.

There is shown in FIG. 1 a ventilated, heat attenuating hat 10. The hat includes an outer mesh section 12 that comprises a side portion 14 and a top portion 16. The side and top portions are interconnected along a seam 18 by conventional means such as stitching or sewing. In alternative embodiments, the side and top portions may be integrally connected. A bill 20 is attached to, and extends from the front of cap 10. A recess 22 is formed in the rear of the cap and an adjustment strap device 24 extends into recess 22. The specific construction of the adjustment strap device 24 and bill 20 are described more fully below.

Outer mesh section 12 as composed includes an aluminized fabric that reflects a significant portion of the solar radiation R that strikes hat 10. At the same time, a significant portion of the air flow A that impinges upon hat 10 is allowed to pass through mesh section 12.

Figure 2:
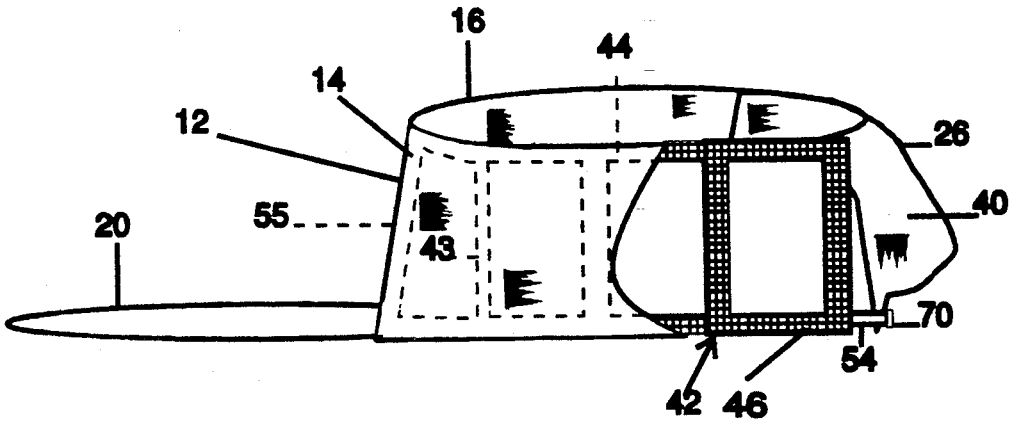
FIG. 2 is a view similar to FIG. 1 of the hat with a portion of the outer mesh section cut away to illustrate the inner mesh section and support grid.
Figure 3:
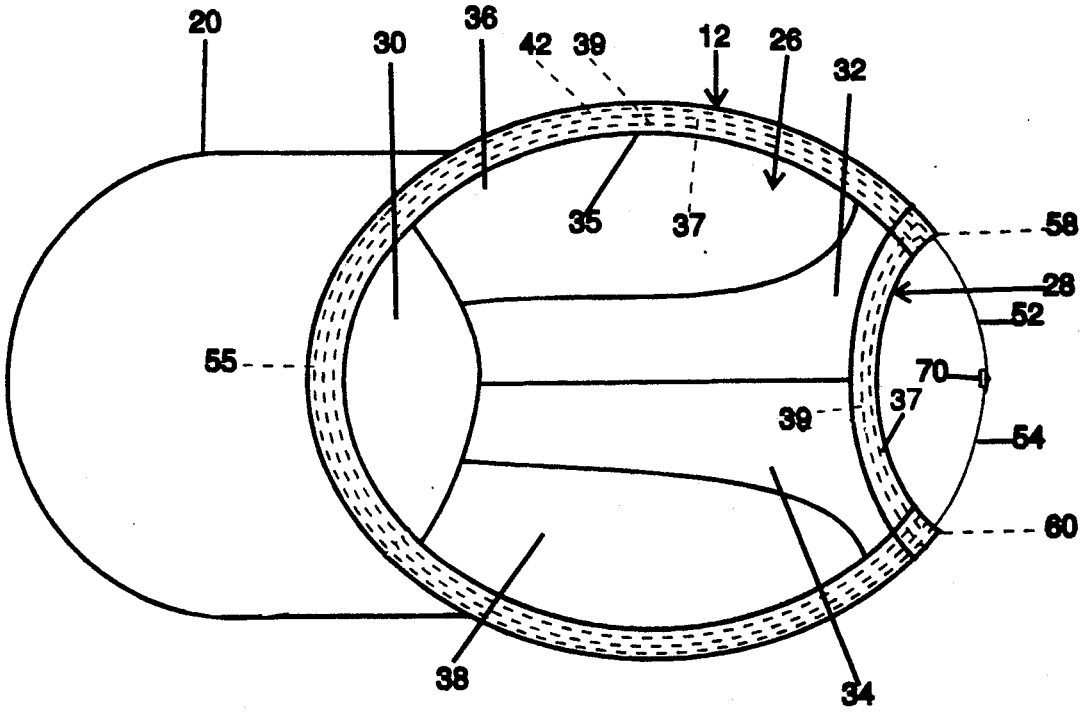
FIG. 3 is a bottom plan view of the hat.

As shown in FIGS. 2 and 3, outer mesh section 12 covers an inner mesh section 26. As best shown in FIG. 3, a lower edge of outer section 12 is folded over lower edge 37 of inner section 26 and stitching 39 permanently interconnects the inner section to the outer section. Various conventional stitching techniques such as a flat feld seam may be employed.

Inner section 26 includes a crown portion 28 for engaging the crown of the wearer's head. Crown portion 28 is more particularly composed of a front segment 30 and a pair of left and right top segments 32 and 34. Inner section 26 also includes a pair of side portions 36 and 38 for engaging the left and right hand sides of the wearer, respectively. Portions 36 and 38 and segments 30, 32 and 34 are interconnected by conventional stitching or sewing techniques. Alternatively, the portions and segments of inner section 26 may be integrally joined.

Inner section 26 is composed of a hydrophobic mesh fabric, preferably having strong wicking capabilities, such as COOLMAX (TM) certified by Dupont Corporation. Such material permits perspiration to be effectively wicked away from the wearer's skin. At the same time, the inner mesh section does not retain that perspiration. Rather, it evaporates the moisture so that the inner mesh section remains relatively dry and comfortable.

To improve heat and light reflection still further, the outer surface 40, FIG. 2 of inner mesh section 26 includes an aluminized fabric. This fabric further reflects at least a portion of the solar radiation that passes through outer mesh section 12. At the same time, because an aluminized fabric is employed the air flow through the cap is not drastically impeded.

Recess 22 is formed by cutting complementary openings, in the shape of recess 22, in both outer and inner mesh sections 12 and 26. Stitching 39 is then formed along the edge of recess 22 to join the inner and outer mesh sections.

Both the inner and outer mesh sections are composed of a fabric which tends to be relatively limp. Accordingly, in order to provide hat 10 with some degree of rigidity and a relatively permanent shape, a support grid 42 is disposed between the inner mesh section 26 and the outer mesh section 12 to support mesh section 12 in a generally erect condition held above inner section 26. Support grid 42, as shown alone in FIG. 4, includes an elongate element composed of a flexible plastic mesh material. The grid includes an upper edge 44, a lower edge 46 and a plurality of transverse elements 48 that interconnect edges 44 and 46. As a result, support grid 42 defines a plurality of rectangular openings 50. A first adjustment element 52 is integrally attached to one end of lower edge 46 and a second adjustment element 54 is integrally formed at the other end of edge 46.

Support grid 42 is formed into a generally oval shape, as shown in FIG. 3, and is disposed between mesh sections 12 and 26 before the mesh sections are sewn together. In particular, as best shown in FIG. 2, support grid 42 is located between the mesh sections such that lower edge 46 extends generally along the brim of hat 10 and upper edge 44 extends generally along the upper edge of side portion 14. As shown in FIG. 3, the grid extends from a first end 58 adjacent one side of recess 22 and an opposite second end 60 adjacent the opposite side of the recess. Although the support grid 42 is somewhat flexible, it is also relatively rigid compared to the material comprising the inner and outer mesh sections. As a result, the upper and lower edges 44 and 46 and the transverse segments 48 maintain the outer mesh section 12 in the generally erect condition shown in FIGS. 1 and 2. Outer mesh section 12 is secured to grid 42 by various means such as stitching, sewing or adhesives.

The openings 50 and the smaller mesh openings through grid 42 define channels between the outer and inner mesh sections 12 and 26. Such channels allow air to pass freely between the mesh sections, unhindered by fiberglass or similar blocking material. As a result, ventilation is improved considerably.

Figure 4:
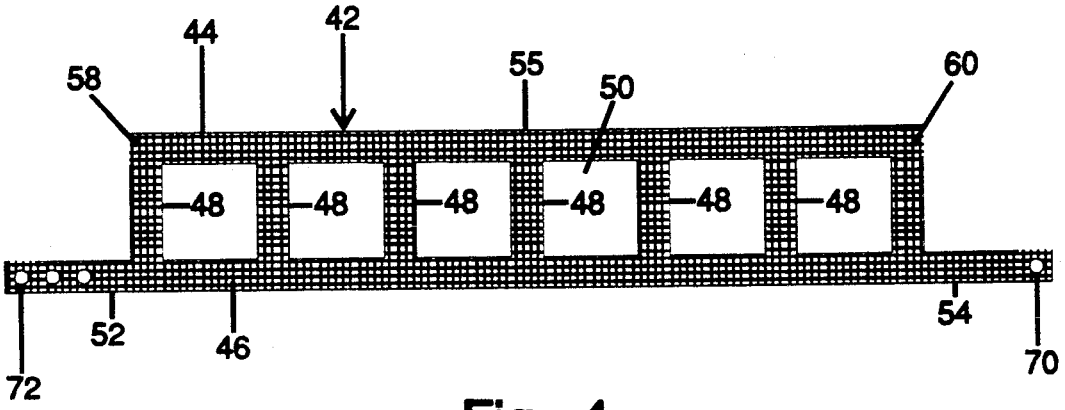
FIG. 4 is an elevational view of the support grid.

Adjustment elements 52 and 54 extend from ends 58 and 60, respectively, into recess 22 and are interengaged, as shown in FIGS. 2 and 3. Elements 52 and 54 include conventional adjustable attachment means such as are used in many known caps and hats. For example, as best shown in FIG. 4, section 54 includes a clasp 70 and section 52 includes a plurality of openings 72, each representing a particular hat size. By interengaging clasp 70 with a selected opening 72 the size of the cap may be adjusted in a known manner.

Figure 5:
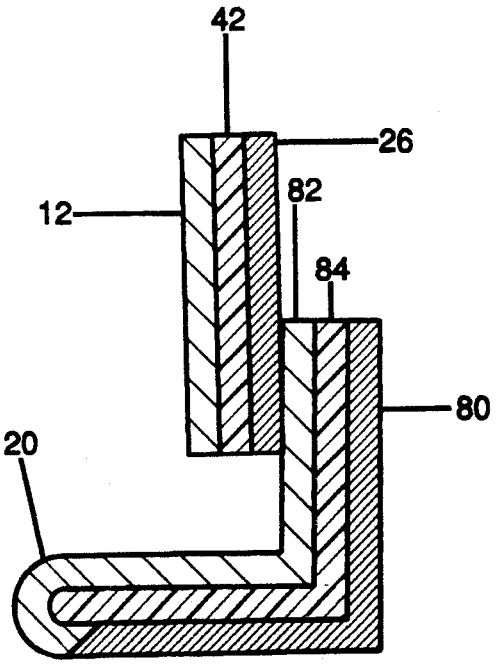
FIG. 5 is an elevational cross sectional view of the bill of the hat.

As shown in FIG. 5, bill 20 includes an inner cloth layer 80 that is sewn or stitched to an outer aluminized fabric 82. A plastic stiffening element 84 is formed between layers 80 and 82. Bill 20 includes an upturned portion that engages inner mesh section 26 and is secured thereto by appropriate means such as sewing, stitching and/or adhesives. In alternative embodiments, the bill may be secured to one or more of the outer mesh section 12 and support grid 42. The manner of attaching the bill may be varied in accordance with known techniques for securing a cap bill to the crown portion of a cap. Nonetheless, bill 20 provides improved results over conventional bills through its use of aluminized fabric 82, which reflects the majority of solar radiation striking bill 20.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. Ventilated, heat attenuating headwear comprising:

an inner mesh section that includes a crown portion for engaging the crown of a wearer's head and a pair of side portions connected to said crown portion for engaging the sides of the wearer's head;

an outer mesh section that covers at least a part of said inner mesh section and is composed of a material that reflects a significant portion of solar radiation that strikes said outer section;

channel means formed between said inner and outer sections for permitting air to flow freely therethrough; and means for interconnecting said inner and outer mesh sections.

2. The headwear of claim 1 in which said inner mesh section includes a wicking and highly evaporative material that rapidly wicks perspiration from the wearer and evaporates said perspiration.

3. The headwear of claim 1 in which said inner mesh section includes a metallic material for reflecting solar radiation therefrom.

4. The headwear of claim 3 in which said metallic material includes a metallized fabric that is formed on an outer surface of said inner mesh section.

5. The headwear of claim 4 in which said metallized fabric includes an aluminized fabric.

6. The headwear of claim 1 in which said material that reflects a significant portion of solar radiation that strikes said outer section includes a metallic material for reflecting solar radiation therefrom.

7. The headwear of claim 6 in which said metallic material includes a metallized fabric.

8. The headwear of claim 7 in which said metallized fabric includes an aluminized fabric.

9. The headwear of claim 1 further including means disposed generally between said inner mesh section and said outer mesh section for supporting said outer mesh section in a generally erect condition over said inner mesh section.

10. The headwear of claim 9 in which said means for supporting include a support grid that is generally rigid relative to said inner and outer mesh sections, said channel means including openings formed in said grid for allowing ventilation therethrough.

11. The headwear of claim 10 in which said outer mesh section is attached to said support grid.

12. The headwear of claim 10 further including a recessed region formed in said inner and outer mesh sections, and in which said support grid includes an elongate member having opposite first and second ends and further having a first adjustment element carried by said first end and a complementary second adjustment element carried by said second end, said first and second adjustment elements extending into said recessed region and including complementary means for interengaging said elements at a selected one of a plurality of relative portions to adjust the size of said headwear.

13. The headwear of claim 1 further including a bill section that is joined to and extends from at least one of said inner and outer mesh sections, said bill section including a metallic material for reflecting solar radiation therefrom.

14. Ventilated, heat attenuating headwear comprising:

an inner mesh section that includes a wicking and highly moisture evaporative material, said inner mesh section having a crown portion for engaging the crown of a wearer's head and a pair of side portions for engaging the sides of the wearer's head, said inner mesh section including a metallized fabric formed on an outer surface thereof for reflecting solar radiation therefrom;

an outer mesh section that covers at least a part of said inner section and includes a metallized fabric for reflecting away from said headwear a significant portion of solar radiation that strikes said outer mesh section;

channel means formed between said inner and outer sections for permitting air to flow freely therethrough; and means for interconnecting said inner and outer mesh sections.

15. Ventilated, heat attenuating headwear comprising:

an inner mesh section having a crown portion for engaging the crown of a wearer's head and a pair of side portions for engaging the sides of the wearer's head, said inner mesh section including a metallic material for reflecting solar radiation therefrom;

an outer mesh section that covers at least a part of said inner section and includes a metallic material for reflecting away from said headwear a significant portion of solar radiation that strikes said outer mesh section;

channel means formed between said inner and outer sections for permitting air to flow freely therethrough; and means for interconnecting said inner and outer mesh sections.

* * * * *